US006320363B1

(12) United States Patent
Oglesbee et al.

(10) Patent No.: US 6,320,363 B1
(45) Date of Patent: Nov. 20, 2001

(54) VOLTAGE REGULATOR WITH IMPROVED TRANSIENT RESPONSE

(75) Inventors: John W. Oglesbee, Watkinsville, GA (US); Gregory J. Smith, Tuscon, AZ (US)

(73) Assignee: Motorola, Inc., Schaumberg, IL (US)

( * ) Notice: Subject to any disclaimer, the term of this patent is extended or adjusted under 35 U.S.C. 154(b) by 0 days.

(21) Appl. No.: 09/639,132

(22) Filed: Aug. 15, 2000

Related U.S. Application Data

(60) Provisional application No. 60/203,795, filed on May 12, 2000, and provisional application No. 60/172,422, filed on Dec. 17, 1999.

(51) Int. Cl.[7] ..... G05F 5/00; G05F 1/40; G05F 1/44

(52) U.S. Cl. ..... 323/303; 323/274; 323/299

(58) Field of Search ..... 323/303, 273, 323/274, 276, 282, 299

(56) References Cited

U.S. PATENT DOCUMENTS 4,390,828 * 6/1983 Converse et al. ..... 323/278
4,536,699 * 8/1985 Baker ..... 323/276
4,580,090 * 4/1986 Bailey et al. ..... 323/303
4,705,572 * 11/1987 Melbert ..... 323/275
4,814,687 * 3/1989 Walker ..... 323/275

* cited by examiner

*Primary Examiner*—Peter S. Wong
*Assistant Examiner*—Bao Q. Vu
(74) *Attorney, Agent, or Firm*—Needle & Rosenberg, P.C.

(57) ABSTRACT

A voltage regulator that includes a transistor, a first amplifier and a second amplifier. The voltage regulator maintains a voltage between a first node and a second node within a predetermined range by maintaining a current level flowing from the first node to the second node. The transistor has a first pole electrically coupled to the first node, a second pole electrically coupled to the second node and a gate. The first amplifier has a first input, a second input and an output, and the second amplifier has a first input, a second input and an output, wherein the first inputs of the first and second amplifiers are electrically coupled to the first node, the second inputs of the first and second amplifiers are electrically coupled to the second node, and the outputs of the first and second amplifiers are electrically coupled to the gate of the transistor, respectively. The first and second amplifiers have different characteristic response times to reach a saturation voltage value. For example, the characteristic time for the second amplifier is faster than that of the first amplifier.

36 Claims, 6 Drawing Sheets

VOLTAGE REGULATOR WITH IMPROVED TRANSIENT RESPONSE

CROSS-REFERENCE TO RELATED APPLICATION

This application claims priority to U.S. Provisional Application Serial No. 60/203,795, entitled "Protection Circuit and Charge Control for Lithium Ion Batteries," which was filed on May 12, 2000, and U.S. Provisional Application Ser. No. 60/172,422, entitled "Method of Improving the Transient Response of a Shunt Regulator Control Loop," which was filed on Dec. 17, 1999.

BACKGROUND OF THE INVENTION

1. Field of the Invention

The present invention relates to voltage protection circuits and, more specifically, to a voltage regulator with improved transient response capable of maintaining voltage within a predetermined range, which can be used as a voltage protection circuit.

2. Description of the Related Art

Excessive voltage can cause detrimental effects in electric appliances and electronic circuits. For example, lithium based batteries, including Lithium-Ion batteries and Lithium-Polymer batteries can be sensitive to and damaged by excessive voltage.

Excessive voltage can come from various external sources in different forms. Transient voltage spikes from external sources are one example. A transient voltage spike can be caused, for example, by an electrostatic discharge (ESD) event. Transient voltage spikes can cause damages in electronic circuits such as overcharging failure.

Currently, several approaches can be utilized to reduce or control impacts of external transient voltage events on various electronic circuits, in particular, semiconductor circuits. One approach widely used in the field of integrated circuit (IC) design is to clamp transient voltages on the inputs of the IC pins to protect the internal IC circuits from external voltage transient events. To do so, a shunt voltage regulator control circuit may be utilized for voltage protection. One example of a shunt voltage regulator is disclosed in U.S. patent application Ser. No. 09/545,135, entitled "Shunt Voltage Regulator with Self-Contained Thermal Crowbar Safety Protection," filed Apr. 7, 2000, which is hereby incorporated by reference for background purposes only. If a shunt voltage regulator is sufficiently fast and of sufficient bandwidth, the shunt voltage regulator can rapidly clamp all external voltage and current transients imposed therein from external sources. In this way, a circuit incorporating such a shunt voltage regulator can protect itself from external voltage transients.

FIG. 1 shows a simple prior art shunt voltage regulator circuit 100 (different from that disclosed in the aforementioned co-pending application). The circuit 100 includes a transistor 110 (such as a metal oxide semiconductor field effect transistor) having a first pole electrically coupled to the first node 102, a second pole electrically coupled to the second node 104 and a gate. The transistor 110 is capable of controlling an electrical current flowing from the first node 102 to the second node 104, i.e., ground, as a function of a voltage at its gate, which is also referred to herein as a controlling port. A voltage reference 150 generates a signal that has a predetermined potential difference from the second node 104. An amplifier 120, having a first input electrically coupled to the first node 102 and a second input electrically coupled to the signal from the voltage reference 150, generates an output electrically coupled to the gate of the transistor 110. The output of the amplifier 120 is thus a function of a voltage difference between the first node 102 and the second node 104.

The voltage regulator circuit 100 can be utilized in many applications. For example, the voltage regulator circuit 100 can be adapted to prevent overcharging of a battery 170 when the battery 170 is subjected to unusually high or excessive voltages, such as a voltage transient spike I. When an unusually high voltage is detected across the battery 170, the voltage regulator 100 increases the current bypassing the battery 170 through the first and second poles of the transistor 110, thereby reducing the voltage across the battery 170. Thus, by adjusting the current that bypasses the battery 170, the circuit 100 keeps the voltage across the nodes of the battery 170 within a desired range.

To achieve the desired protection, a shunt voltage regulator circuit should be optimized with respect to its circuit characteristics for fast response and wide bandwidth. One advantage for a voltage regulator circuit having fast response is that the voltage regulator circuit may protect itself, in addition to circuits the voltage regulator circuit may be adapted to protect, from excessive voltage transients. However, as is known in the art, such optimization may result in a shunt voltage regulator circuit that has poor steady state control accuracy. For example, in applications related to battery protection, this can result in an undesirable degradation of battery cell protection performance. On the other hand, a shunt voltage regulator circuit that is optimized for best steady state accuracy, as is required for good cell protection, is likely not to have the fast response and wide bandwidth required to adequately protect itself from excessive voltage transients.

There is therefore a need for a shunt voltage regulator that can have steady state control accuracy and the fast response and wide bandwidth with respect to external voltage transients.

DETAILED DESCRIPTION OF THE INVENTION

Figure 1:
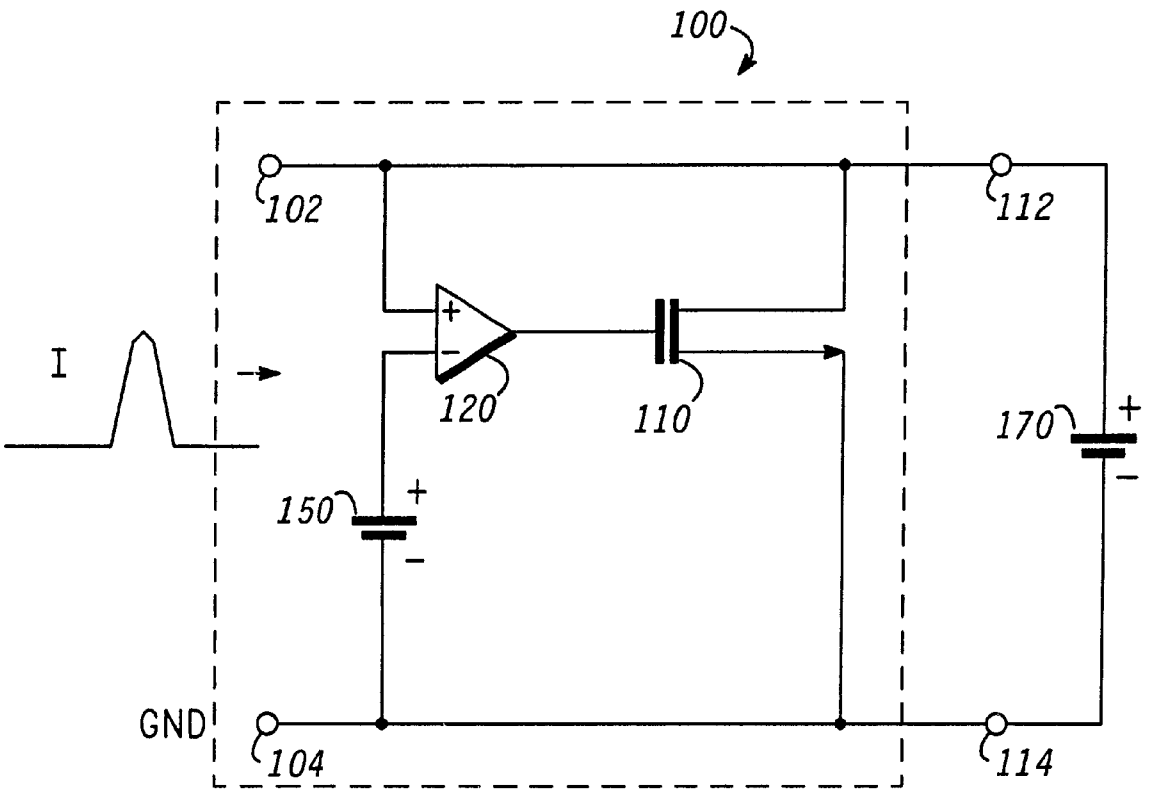
FIG. 1 (PRIOR ART)
FIG. 1 is a schematic diagram of a prior art circuit.

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Also, "battery" includes single cell batteries and multiple cell batteries. Furthermore, "voltage regulator" and "voltage regulator circuit" are used interchangeably.

In one embodiment, the invention is a voltage regulator used to prevent overcharging of a battery or a circuit in situations in which the battery or the circuit is subjected to unusually high voltages. The voltage regulator employs a voltage control circuit that keeps the voltage across the nodes of the battery or the circuit within a desired or predetermined range. The voltage regulator has an improved transient response with steady state control accuracy and wide bandwidth with respect to external voltage transients. It does so by use of two or more voltage control loops operating in parallel, wherein each of the voltage control loops includes an amplifier that has a characteristic to reach a saturation value of voltage responsive to a voltage signal in a particular time range that can be characterized relatively as "slow," "fast" or "very fast" as discussed in more detail infra. By operating in parallel, it is meant that in response to an external voltage signal, one of the voltage control loops is selectively turned on, depending on the rate of the change of the external voltage signal over time or the overdrive signal caused by the external voltage signal. The voltage control loop that is turned on to perform a clamping action associated with a shunt power transistor dominates the operation of the shunt power transistor. Thus, by using a "slow" but accurate control loop in parallel with a "fast" but less accurate control loop, requirements for both high accuracy and wide bandwidth may be simultaneously met with a single shunt power transistor circuit. For slowly rising voltage transients, the voltage regulator is able to respond timely with excellent accuracy, because the performance is dominated by the slow control loop. For fast rising transients, the voltage regulator is still able to respond timely and protect the voltage regulator itself because now the performance is dominated by the fast control loop. Overall, a voltage regulator with improved transient response and self-protection ability is provided by the present invention.

Figure 2:
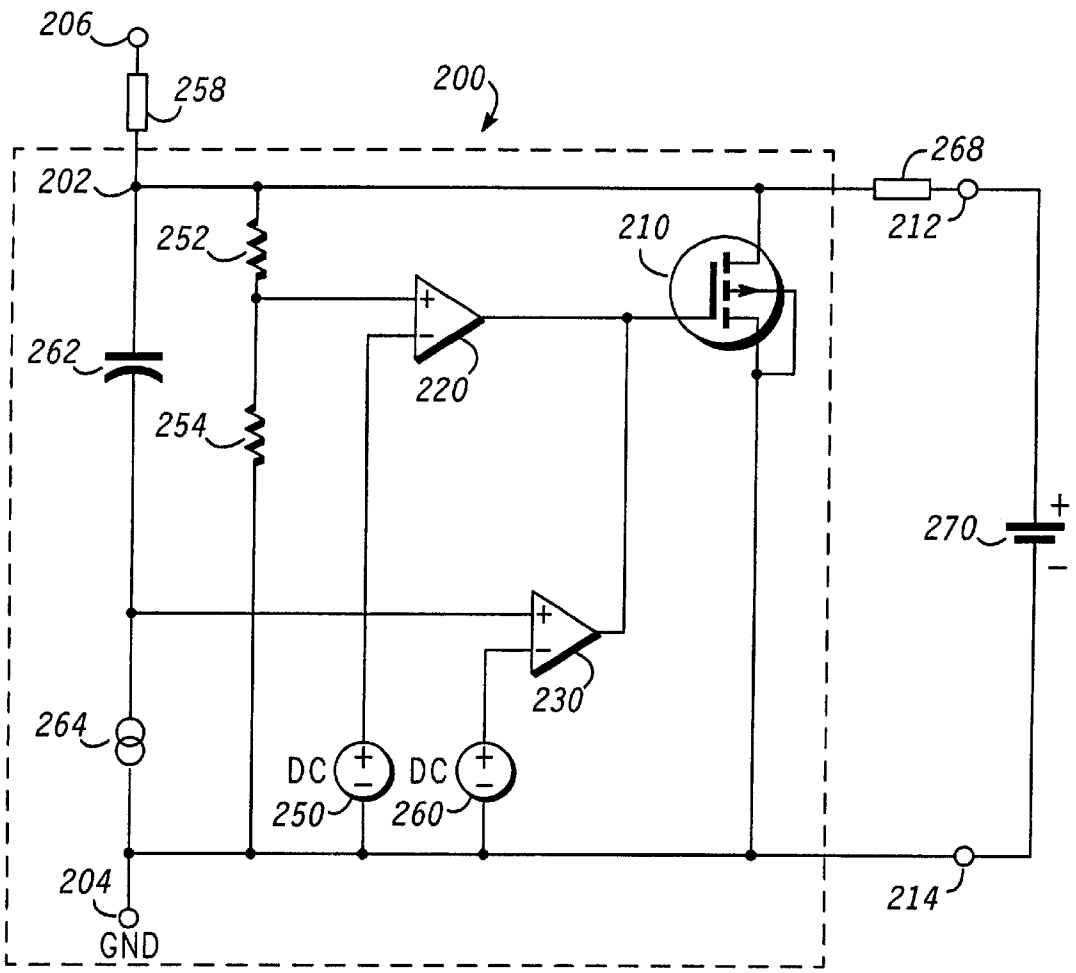
FIG. 2 is a schematic diagram of a shunt voltage regulator circuit in accordance with one embodiment of the invention.

As shown in FIG. 2, one embodiment of the invention is directed to a voltage regulator 200 that can maintain a voltage between a first node 202 and a second node 204 within a predetermined range (for example, 4.5 V in the case of the regulator being used in association with a lithium ion battery charger) by maintaining a current level flowing from the first node 202 to the second node 204. The current level is a function of a voltage between a selected node (e.g., the first node 202) and the second node 204.

The voltage regulator 200 includes a transistor 210 (such as a field effect transistor) having a first pole electrically coupled to the first node 202, a second pole electrically coupled to the second node 204 and a gate. The transistor 210 is capable of controlling an electrical current flowing from the first node 202 to the second node 204 as a function of a voltage at its gate, which is also referred to herein as a controlling port. The voltage regulator 200 also has a first amplifier 220 and a second amplifier 230, each having a first input, a second input and an output. The first inputs of the first and second amplifiers 220, 230 are electrically coupled to the first node 202, the second inputs of the first and second amplifiers 220, 230 are electrically coupled to the second node 204, and the outputs of the first and second amplifiers 220, 230 are electrically coupled to the gate of the transistor 210. The outputs of the first and second amplifiers 220, 230 each is thus a function of a voltage difference between the first node 202 and the second node 204. Additionally, a first voltage reference 260 generates a signal or offset having a predetermined potential difference from the second node 204. The second input of the first amplifier 220 is electrically coupled to the signal generated from the first voltage reference 250. Moreover, a second voltage reference 260 generates a signal or offset having a predetermined potential difference from the second node 204. The second input of the second amplifier 230 is electrically coupled to the signal generated from the second voltage reference 260.

The first and second amplifiers 220, 230 each has a characteristic to reach a saturation value of voltage, responsive to a voltage signal, such as an external voltage transient, in a particular time range that can be characterized relatively as "slow," "fast" or "very fast." Throughout this disclosure, unless otherwise clarified, the first and second amplifiers 220, 230 are characterized as a "slow" amplifier and a "fast" amplifier, respectively, if the second amplifier 230 responds to a voltage signal at least twice as fast as the first amplifier 220. Likewise, the first and second amplifiers 220, 230 are characterized as a "slow" amplifier and a "very fast" amplifier, respectively, if the second amplifier 230 responds to a voltage signal at least three times as fast as the first amplifier 220. For example, if the first amplifier 220 as a "slow" amplifier has a characteristic response time T, the second amplifier 230 is a"fast" amplifier when it has a characteristic response time smaller than or equal to (T/2), or a "very fast" amplifier when it has a characteristic response time smaller than or equal to (T/3). For each amplifier, the characteristic response time is in a variable range. As an example, if a first amplifier having a characteristic to reach the saturation value of voltage in the range of 0.1 to 100 milliseconds is a "slow" amplifier, a second amplifier will be characterized as a "fast" amplifier if the second amplifier has a characteristic to reach the saturation value of voltage in the range of 0.1 to 100 microseconds, or a "very fast" amplifier if the second amplifier has a characteristic to reach the saturation value of voltage in the range of 0.1 to 100 nanoseconds.

Still referring to FIG. 2, in one embodiment of the present invention, the first amplifier 220 and the second amplifier 230 are chosen as a "slow" amplifier and a "fast" amplifier. The first voltage reference 250 and the second voltage reference 260 are arranged so that different offsets are provided to the first amplifier 220 and the second amplifier 230, respectively. Specifically, during a steady, normal operation state, the first amplifier 220 is active to provide accurate voltage control, and the second voltage reference 260 provides a larger offset (than the offset provided by the first voltage reference 250 to the first amplifier 220) to the second amplifier 230 so that the second amplifier 230 is inactive. However, during a transient voltage event, the excessive voltage signal may overcome the offset of the second voltage reference 260 and thus activate the second amplifier 230 so that the second amplifier 230, being faster than the first amplifier 220, can respond more quickly to the excessive voltage signal, while the first amplifier 220 move slowly responds to it. Thus, the voltage regulator 200 is able to provide steady, accurate voltage control by the first amplifier 220 during normal operation and fast response and desired voltage protection by the second amplifier 230 during a transient voltage event. When setting the offsets of the first voltage reference 250 and the second voltage reference 260, the offset of the second voltage reference 260, relative to the offset of the first voltage reference 250, should be large enough so that only the first amplifier 220 is active during normal operation, and small enough so that the second amplifier 230 is activated upon an excessive voltage event before the excessive voltage exceeds any safe operational voltage limits.

Figure 4:
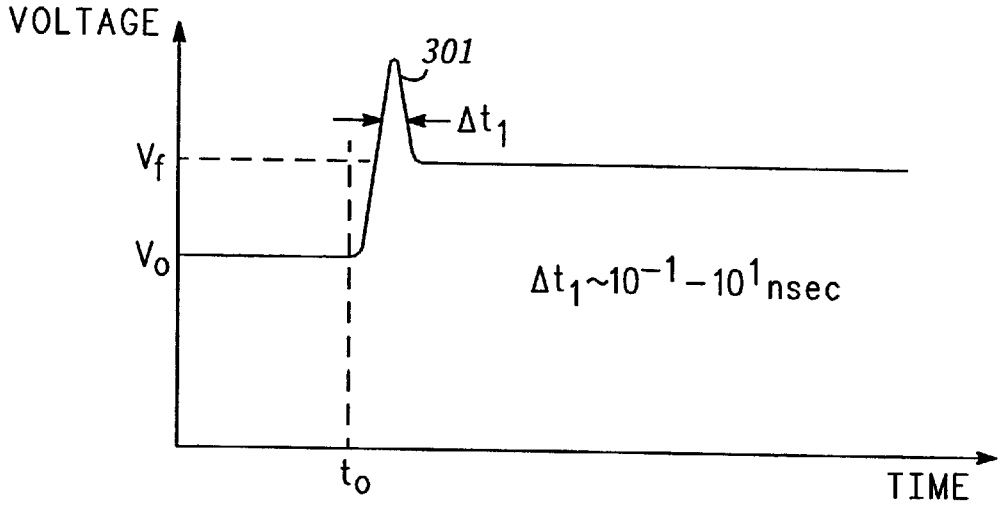
FIG. 4 is a graphical diagram showing a characteristic response of a very fast amplifier that can be utilized in the embodiments of the invention as shown in FIGS. 2–3.
Figure 5:
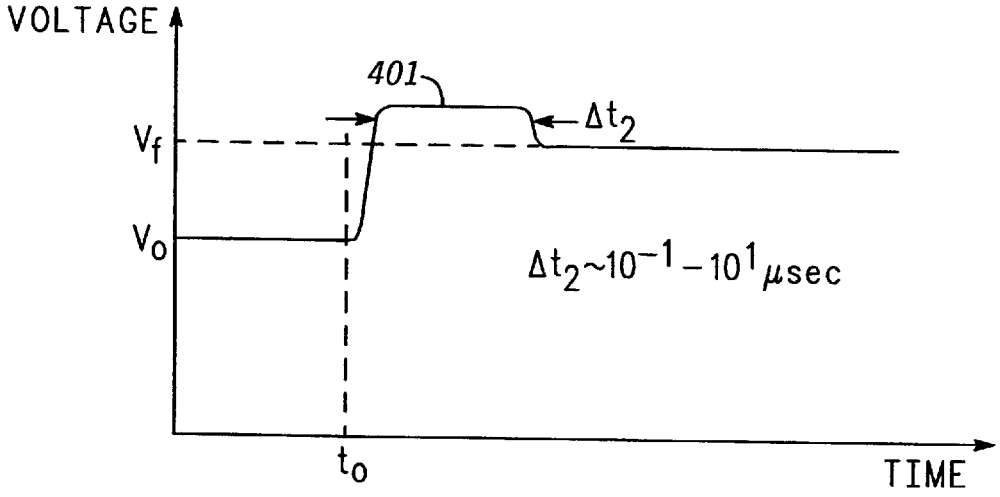
FIG. 5 is a graphical diagram showing a characteristic response of a fast amplifier that can be utilized in the embodiment of the invention as shown in FIGS. 2–3.
Figure 6:
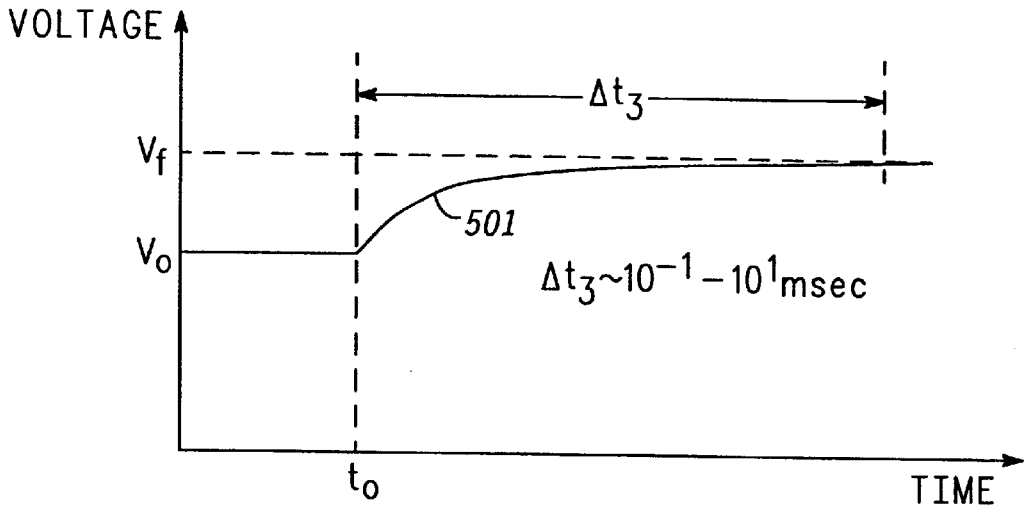
FIG. 6 is a graphical diagram showing a characteristic response of a slow amplifier that can be utilized in the embodiment of the invention as shown in FIGS. 2–3.

FIGS. 4–6 show characteristic responses 301, 401 and 501 of very fast, fast, and slow amplifiers, respectively, which can be utilized in the invention. In FIGS. 4–6, $V_0$ indicates an initial voltage and $V_f$ indicates a final voltage (for example, 4.5 V in the case of the regulator being used in association with a lithium ion battery charger) that the voltage regulator 200 intends to maintain, $t_0$ indicates the time when an external voltage signal such as an external voltage transient is imposed to the amplifier, and $\Delta t$ represents the time range needed for the amplifier to reach the saturation value of voltage, here $V_f$, from $t_0$.

Additional elements may be added to the circuit to add certain features. For example, voltage dividers or voltage suppliers can be used to provide proper input signal to the first and second amplifiers 220, 230. In FIG. 2, a first electrical load such as a resistor 252 can be electrically coupled between the first node 202 and the first input of the first amplifier 220 to provide a signal to the first input of the first amplifier 220 with a proper potential difference from the second node 204. Likewise, a second electrical load such as a resistor 254 can be electrically coupled between the second node 204 and the first input of the first amplifier 220 to provide a signal to the first input of the first amplifier 220 with a proper potential difference from the second node 204. In combination, resistors 252, 254 function as a voltage divider. Together with the first voltage reference 250 and the second voltage reference 260, they can be utilized to provide proper offset voltages to the first amplifier 220 and the second amplifier 230, respectively. A current source 264 can also be added to the circuit 200 as shown in FIG. 2.

Many applications can be found for the voltage regulator 200. For example, the voltage regulator 200 can be adapted to provide overvoltage protection to the battery cell 270 as shown in FIG. 2. Current flow-restricting elements 258 and 268, one of which is electrically coupled between the first node 202 and a third node 206, and another of which is electrically coupled between the first node 202 and the battery cell 270, can be utilized to prevent current from flowing from battery cell 270 to the second node 204 through the voltage regulator 200 when the voltage regulator 200 is allowing a saturation value of current from the first node 202 to the second node 204. Each of the current flow-restricting elements 258, 268 can include a fuse (not shown) that creates an open circuit when current is above a predetermined value or threshold. Each of the current flow-restricting elements can also include a diode (not shown) biased to allow current to flow only from the third node 206 to the first node 202. The current flow-restricting element can further include a transistor (not shown), wherein a portion of the transistor that represents an anode is electrically coupled to the third node 206 and a portion of the transistor that represents a cathode is electrically coupled to the first node 202 and wherein the transistor includes a gate that is coupled to a control signal from an external source (not shown). Additional one or more current flow-restricting elements may be provided. Each of the current flow-restricting elements may include, for example, fuses, transistors, switches, diodes, sensors such as positive temperature coefficient devices, capacitors, resistors, inductors, or any combination of them.

The voltage regulator 200 can be fabricated on a single integrated circuit as a single, self-contained two terminal or three terminal device (or more terminals), thereby allowing it to be manufactured at low cost and, thus, be included in many power applications where cost is an important consideration. Such applications include: batteries, battery chargers and any application where a voltage regulator is needed. Being fabricated on a single integrated circuit, the invention takes up relatively little space, thereby allowing it to be used in many applications in which space limitations are an important consideration (e.g., cell phones, cell phone batteries, pagers, etc.). As would be known to those of skill in the art, the invention may be embodied using discrete components by sacrificing some of the cost and size advantages of the single integrated circuit embodiment.

Figure 3:
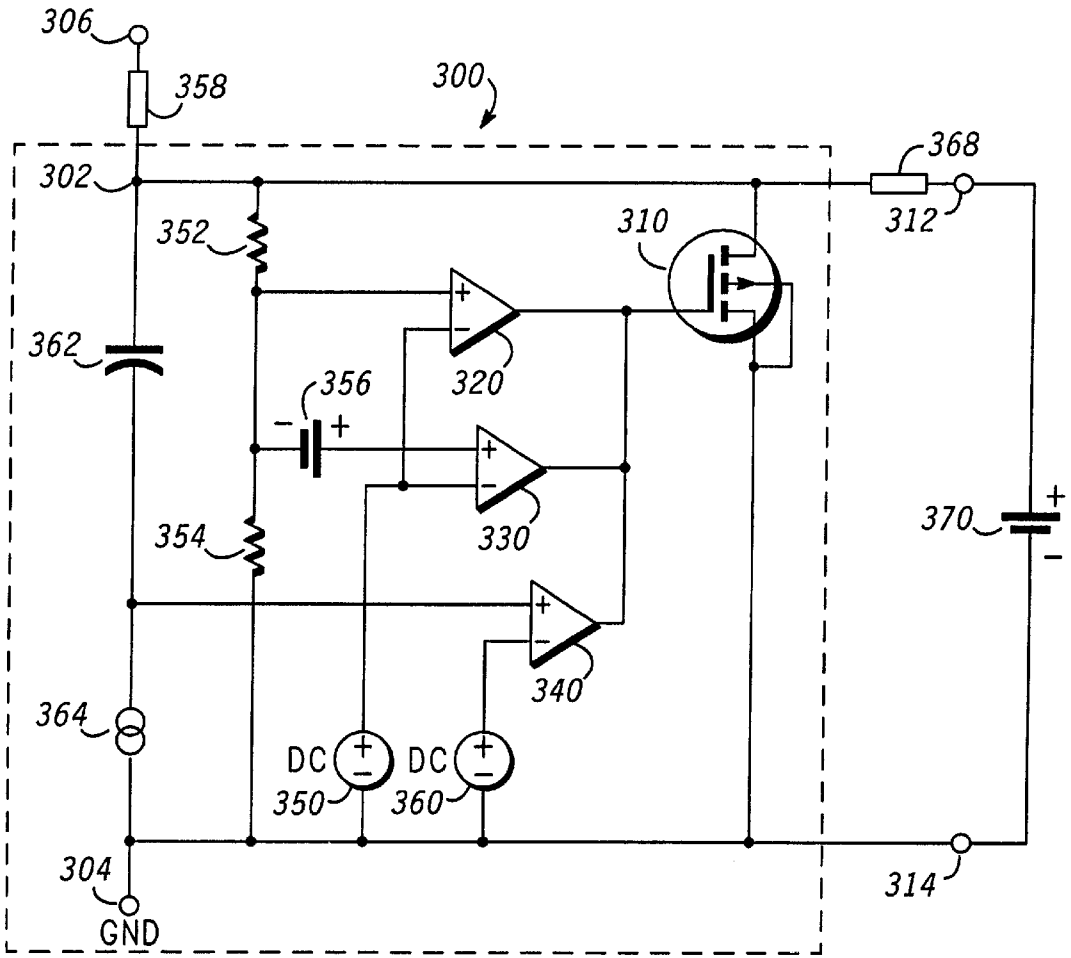
FIG. 3 is a schematic diagram of a shunt voltage regulator circuit in accordance with another embodiment of the invention.

FIG. 3 shows another embodiment of the invention, where a voltage regulator 300 can maintain a voltage between a first node 302 and a second node 304 within a predetermined range (for example, 4.5 V in the case of the regulator being used in association with a lithium ion battery charger) by maintaining a current level flowing from the first node 302 to the second node 304. The current level is a function of a voltage between a selected node (e.g., the first node 302) and the second node 304.

The voltage regulator 300 includes a transistor 310 (such as a field effect transistor) having a first pole electrically coupled to the first node 302, a second pole electrically coupled to the second node 304 and a gate. The transistor 310 is capable of controlling an electrical current flowing from the first node 302 to the second node 304 as a function of a voltage at its gate, which is also referred to herein as a controlling port. The voltage regulator 300 also has a first amplifier 320, a second amplifier 330 and a third amplifier 340, each having a first input, a second input and an output. The first inputs of the first, second and third amplifiers 320, 330, 340 are electrically coupled to the first node 302. The second inputs of the first, second and third amplifiers 320, 330, 340 are electrically coupled to the second node 304. The outputs of the first, second and third amplifiers 320, 330, 340 are electrically coupled to the gate of the transistor 310. The outputs of the first, second and third amplifiers 320, 330, 340 each is thus a function of a voltage difference between the first node 302 and the second node 304.

Figure 7:
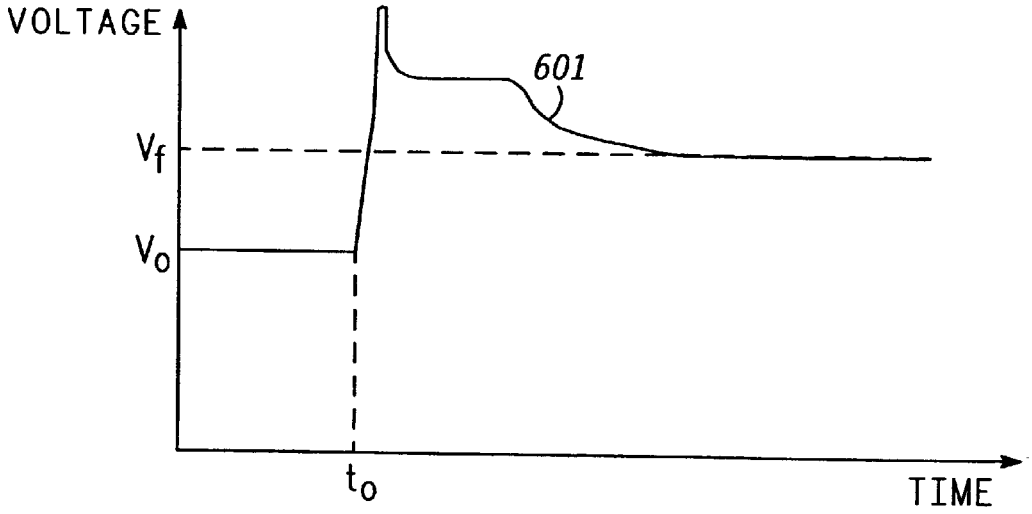
FIG. 7 is a graphical diagram showing a characteristic response of a combination of three types of amplifiers as shown in FIGS. 4–6.

The first, second and third amplifiers 320, 330 and 340 each can be a slow, fast, or very fast amplifier. In one embodiment, the second amplifier 330 responds to a voltage signal faster than the first amplifier 320, and the third amplifier 340 responds to the voltage signal faster than the second amplifier 330. In another embodiment of the present invention, the characteristic of the third amplifier 340 is chosen in coordination with the choices of the characteristics of the first and second amplifiers 320 and 330. Specifically, the first amplifier 320 is chosen as a slow amplifier, the second amplifier 330 is chosen as a fast amplifier, and the third amplifier 340 is chosen as a very fast amplifier. FIG. 7 shows a combined characteristic response of the first amplifier 320, the second amplifier 330, and the third amplifier 340, which are operated in parallel, as shown in FIG. 3. In this embodiment, the first input of the third amplifier 340 may be electrically coupled to the first node 302 through a capacitor 362 to ensure that only a relatively fast rising external voltage transient is coupled to the third amplifier 340 because the third amplifier 340 in this embodiment is a very fast amplifier suitable for responding rapidly to the relatively fast rising external voltage transient.

Still referring to FIG. 3, a first voltage reference 350 generates a signal or offset having a predetermined potential difference from the second node 304. The second inputs of the first amplifier 320 and the second amplifier 330 are electrically coupled to the signal generated from the first voltage reference 350. A second voltage reference 360 generates a signal or offset having a predetermined potential difference from the second node 304. The second input of the third amplifier 340 is electrically coupled to the signal generated from the second voltage reference 360. A third voltage reference 356 is electrically coupled between the first node 302 and the first input of the second amplifier 330 so that the second amplifier 330 is provided with an offset different from the offset provided to the first amplifier 320. That ensures the second amplifier 330 is in an inactive state when the first amplifier 320 performs the voltage control during normal operation. The activation of the third amplifier 340 depends on the rate of the change of the external voltage signal over time and the third amplifier 340 only operates in response to a relatively fast rising external voltage transient.

Alternatively, for a voltage regulator of the present invention having three amplifiers, any one of the three amplifiers can be chosen as a slow amplifier, one of the other two amplifiers can be chosen as a fast amplifier, and the last one can be chosen as a very fast amplifier. Furthermore, for a voltage regulator of the present invention that utilizes two amplifiers, one of the two amplifiers can be chosen as a slow or fast amplifier, the other can be chosen as a fast amplifier or very fast amplifier, respectively.

Additional elements may be added to the voltage regulator 300 to add certain features as well. For example, voltage dividers such as resistors 352, 354, current flow-restricting elements 358, 368, current source 364 and other elements can be incorporated therein. Each of the current flow-restricting elements may include, for example, fuses, transistors, switches, diodes, sensors such as positive temperature coefficient devices, resistors, capacitors, inductors, or any combination of them. Many applications can be found for the voltage regulator 300. For example, as shown in FIG. 3, the voltage regulator 300 can be adapted to provide over voltage protection to a battery cell 370.

The voltage regulator 300 can be fabricated on a single integrated circuit as a single, self-contained two terminal or three terminal device (or more terminals), thereby allowing it to be manufactured at low cost and, thus, be included in many power applications where cost is an important consideration. Such applications include: batteries, battery chargers and any application where a voltage regulator is needed. Being fabricated on a single integrated circuit, the invention takes up relatively little space, thereby allowing it to be used in many applications in which space limitations are an important consideration (e.g., cell phones, cell phone batteries, pagers, etc.). As would be known to those of skill in the art, the invention may be embodied using discrete components by sacrificing some of the cost and size advantages of the single integrated circuit embodiment.

To generalize, the present invention is directed to a voltage regulator for maintaining a voltage between a first node and a second node within a predetermined range including a transistor having a first pole electrically coupled to the first node, a second pole electrically coupled to the second node and a gate. The transistor is capable of controlling an electrical current flowing from the first node to the second node as a function of a voltage at its gate. The voltage regulator includes a plurality of amplifiers up to N amplifiers, where N is an integer greater than one. Each of the N amplifiers has a first input, a second input and an output wherein the first inputs of the plurality of amplifiers are electrically coupled to the first node, the second inputs of the plurality of amplifiers are electrically coupled to the second node, and the outputs of the plurality of amplifiers are electrically coupled in common to the gate of the transistor.

Furthermore, the voltage regulator has at least one voltage reference that generates a signal having a predetermined potential difference from the second node, wherein at least one of the second inputs of the plurality of amplifiers is electrically coupled to the signal from the at least one voltage reference. In this embodiment of the present invention, each of the plurality of amplifiers has a characteristic to reach a saturation value of voltage responsive to a voltage signal applied between the corresponding first and second inputs in a predetermined time range, which defines a characteristic of an amplifier. The predetermined time ranges of the plurality of amplifiers are different. The predetermined time range for any of the plurality of amplifiers can be selected from a range between 0.1 nanoseconds to 10 seconds. Because each of the plurality of amplifiers of the voltage regulator has a different characteristic responsive to a voltage signal, the voltage regulator of the present invention is capable of responding to an external voltage transient that may be imposed on the voltage regulator with an amplifier that has a characteristic matched to the changing rate of the external voltage transient.

Figure 8:
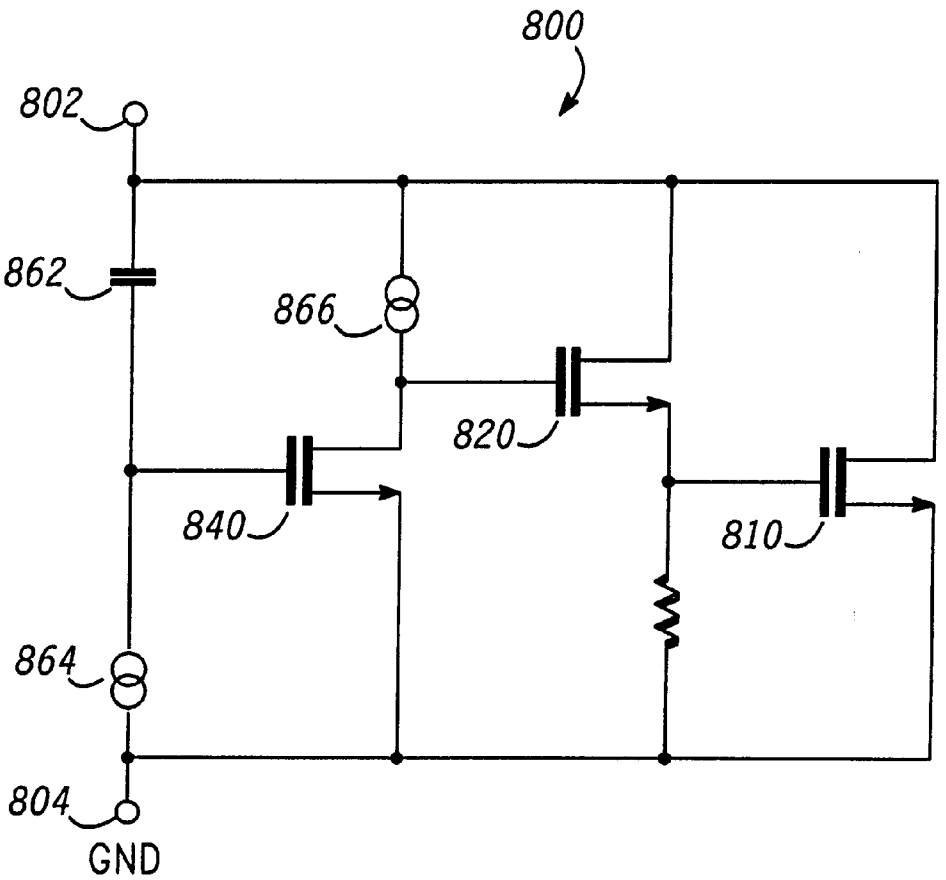
FIG. 8 is a schematic diagram of a shunt voltage regulator circuit in accordance with yet another embodiment of the invention.

FIG. 8 shows yet another embodiment of the invention, where a voltage regulator 800 can maintain a voltage between a first node 802 and a second node 804 within a predetermined range (for example, 4.5 V in the case of the regulator being used in association with a lithium ion battery charger) by maintaining a current level flowing from the first node 802 to the second node 804. The current level is a function of a voltage between a selected node (e.g., the first node 802) and the second node 804.

The voltage regulator 800 includes a transistor 810 (such as a field effect transistor) having a first pole electrically coupled to the first node 802, a second pole electrically coupled to the second node 804 and a gate. The transistor 810 is capable of controlling an electrical current flowing from the first node 802 to the second node 804 as a function of a voltage at its gate, which is also referred to herein as a controlling port. The voltage regulator 800 also has a first amplifying transistor 820 and a second amplifying transistor 840, each having a first pole, a second pole and a gate. The first poles of the first and second amplifying transistors 820, 840 are electrically coupled to the first node 802. The second poles of the first and second amplifying transistors 820, 840 are electrically coupled to the second node 804. The outputs of the first and second amplifying transistors 820, 840 each is thus a function of a voltage difference between the first node 802 and the second node 804.

A capacitor 862 is coupled to the gate of the second amplifying transistor 840, which functions as the positive input of the second amplifying transistor 840. The second pole of the second amplifying transistor 840 is electrically coupled to the second node 804, functioning as a negative input. The second amplifying transistor 840 has a gate threshold voltage. Thus, only voltage signals applied to the first node 802 and the second node 804 and coupled to the gate of the second amplifying transistor 840 by the capacitor 862, which exceed the gate threshold voltage, are actually amplified or regulated by the voltage regulator 800. A first current source 864 and/or a second current source 866 can also be added to the circuit 800 as shown in FIG. 8.

The above described embodiments are given as illustrative examples only. It will be readily appreciated that many deviations may be made from the specific embodiments disclosed in this specification without departing from the invention. For example, the embodiments of the invention are given using amplifiers, where each amplifier can include one or more transistors. Alternatively, each amplifier can be replaced by other amplifying means such as a circuit with multiple feed forward paths. Accordingly, the scope of the invention is to be determined by the claims below rather than being limited to the specifically described.

What is claimed is:

1. A voltage regulator for maintaining a voltage between a first node and a second node within a predetermined range, comprising:

a. a transistor having a first pole electrically coupled to the first node, a second pole electrically coupled to the second node, and a gate;

b. a first amplifier having a first input, a second input and an output; and c. a second amplifier having a first input, a second input and an output, wherein the first inputs of the first and second amplifiers are electrically coupled to the first node and the second inputs of the first and second amplifiers are electrically coupled to the second node so that the first and second amplifiers sense the same signal which represents the voltage between the first node and the second node, and the outputs of the first and second amplifiers are electrically coupled to the gate of the transistor, wherein the second amplifier is faster than the first amplifier responsive signal that is sensed.

2. The voltage regulator of claim 1, further comprising a first voltage reference that generates a signal having a predetermined potential difference from the second node, wherein the second inputs of the first and second amplifiers are electrically coupled to the signal from the first voltage reference.

3. The voltage regulator of claim 1, wherein the first amplifier has a characteristic time to reach a saturation value of voltage responsive to a voltage signal applied between the first and second inputs.

4. The voltage regulator of claim 3, wherein the characteristic time of the first amplifier is in the range of from 0.1 to 10 millisecond.

5. The voltage regulator of claim 3, wherein the characteristic time of the first amplifier is in the range of from 0.1 to 10 microsecond.

6. The voltage regulator of claim 1, wherein the second amplifier has a characteristic time to reach a saturation value of voltage responsive to a voltage signal applied between the first and second inputs.

7. The voltage regulator of claim 6, wherein the characteristic time of the second amplifier is in the range of from 0.1 to 10 microsecond.

8. The voltage regulator of claim 7, wherein the characteristic time of the second amplifier is in the range of from 0.1 to 10 nanosecond.

9. The voltage regulator of claim 1, wherein the second amplifier is at least twice as fast as the first amplifier responsive to a voltage signal.

10. The voltage regulator of claim 1, wherein the second amplifier is at least three times as fast as the first amplifier responsive to a voltage signal.

11. The voltage regulator of claim 1, further comprising a current flow-restricting element electrically coupling the first node to a third node to prevent current flowing from a battery cell to the second node through the voltage regulator when the voltage regulator is allowing a saturation value of current to flow from the first node to the second node.

12. The voltage regulator of claim 11, wherein the current flow-restricting element comprises a fuse, a transistor, a switch, a diode, a sensor, a resistor, a capacitor, an inductor, or a combination of them.

13. The voltage regulator of claim 1, further comprising a voltage divider having a first electrical load electrically coupled between the first node and the first input of the first amplifier and a second electrical load electrically coupled between the second node and the first input of the first amplifier.

14. A voltage regulator for maintaining a voltage between a first node and a second node within a predetermined range, comprising:

a. a transistor having a first pole electrically coupled to the first node, a second pole electrically coupled to the second node, and a gate;

b. a first amplifier having a first input, a second input and an output; and c. a second amplifier having a first input, a second input and an output, wherein the first inputs of the first and second amplifiers are electrically coupled to the first node, the second inputs of the first and second amplifiers are electrically coupled to the second node, and the outputs of the first and second amplifiers are electrically coupled to the gate of the transistor; and d. a third amplifier having a first input, a second input and an output, wherein the first input of the third amplifier is electrically coupled to the first node, the second input of third amplifier is electrically coupled to the second node, and the output of third amplifier is electrically coupled to the gate of the transistor.

15. The voltage regulator of claim 14, further comprising a second voltage reference that generates a signal having a predetermined potential difference from the second node, wherein the second input of third amplifier is electrically coupled to the signal from the second voltage reference.

16. The voltage regulator of claim 14, wherein the third amplifier is faster than the first amplifier or the second amplifier responsive to a voltage signal.

17. The voltage regulator of claim 14, wherein the third amplifier is at least twice as fast as the first amplifier or the second amplifier responsive to a voltage signal.

18. The voltage regulator of claim 14, wherein the third amplifier is at least three times as fast as the first amplifier or the second amplifier responsive to a voltage signal.

19. The voltage regulator of claim 14, wherein the third amplifier has a characteristic time to reach a saturation value of voltage responsive to a voltage signal applied between the first and second inputs.

20. The voltage regulator of claim 14, wherein the characteristic time of the third amplifier is in the range of from 0.1 to 10 nanosecond.

21. The voltage regulator of claim 14, further comprising a capacitance electrically coupled between the first node and the first input of the third amplifier.

22. A voltage regulator for maintaining a voltage between a first node and a second node within a predetermined range, comprising:

a. a transistor having a first pole electrically coupled to the first node, a second pole electrically coupled to the second node, and a gate; and b. a plurality of amplifiers each having a first input, a second input and an output;

wherein the first inputs of the plurality of amplifiers are electrically coupled to the first node and the second inputs of the plurality of amplifiers are electrically coupled to the second node so that the plurality of amplifiers sense the same signal which represents the voltage between the first node and the second node, and the outputs of the plurality of amplifiers are electrically coupled in common to the gate of the transistor, wherein a first of said plurality of amplifiers is faster than a second of said plurality of amplifiers responsive to the signal that is sensed.

23. The voltage regulator of claim 22, further comprising at least one voltage reference that generates a signal having a predetermined potential difference from the second node, wherein at least one of the second inputs of the plurality of amplifiers is electrically coupled to the signal from the first voltage reference.

24. The voltage regulator of claim 22, wherein each of the plurality of amplifiers has a characteristic time to reach a saturation value of voltage responsive to a voltage signal applied between the corresponding first and second inputs.

25. The voltage regulator of claim 24, wherein the characteristic time for each of the plurality of amplifiers is in a predetermined time range.

26. The voltage regulator of claim 25, wherein the predetermined time range for each of the plurality of amplifiers is selected from 0.1 nanosecond to 10 seconds.

27. A voltage regulator for maintaining a voltage between a first node and a second node within a predetermined range, comprising:

a. means for controlling an electrical current flowing from the first node and a second node, wherein the controlling means has a first pole electrically coupled to the first node, a second pole electrically coupled to the second node, and a controlling port;

b. first amplifying means for providing a control signal to the controlling port of the controlling means, wherein the first amplifying means has a first input, a second input and an output; and c. second amplifying means for providing a control signal to the controlling port of the controlling means, wherein the second amplifying means has a first input, a second input and an output, wherein the first inputs of the first and second amplifying means are electrically coupled to the first node and the second inputs of the first and second amplifying means are electrically coupled to the second node so that the first amplifying means and the second amplifying means sense the same signal representing the voltage between the first node and the second node, and the outputs of the first and second amplifying means are electrically coupled to the controlling port of the controlling means, wherein the first amplifying means is faster than the second amplifying responsive to the signal that is sensed.

28. The voltage regulator of claim 27, wherein each of the first and second amplifying means has a characteristic time to reach a saturation value of voltage responsive to a voltage signal applied between the corresponding first and second inputs.

29. A voltage regulator for maintaining a voltage between a first node and a second node within a predetermined range, comprising:

a. means for controlling an electrical current flowing from the first node and a second node, wherein the controlling means has a first pole electrically coupled to the first node, a second pole electrically coupled to the second node, and a controlling port;

b. first amplifying means for providing a control signal to the controlling port of the controlling means; and c. second amplifying means for providing a control signal to the controlling port of the controlling means;

wherein the first amplifying means and the second amplifying means sense the same signal representing the voltage between the first node and the second node, and the first amplifying means is faster than the second amplifying means responsive to the signal that is sensed.

30. The voltage regulator of claim 29, wherein each of the first and second amplifying means has a characteristic time responsive to a voltage signal applied between the first node and the second node.

31. The voltage regulator of claim 29, wherein the first amplifying means comprises a transistor, an amplifying path, a circuit, or a combination of them.

32. The voltage regulator of claim 29, wherein the second amplifying means comprises a transistor, an amplifying path, a circuit, or a combination of them.

33. A voltage regulator for maintaining a voltage between a first node and a second node within a predetermined range, comprising:

a. a transistor having a first pole electrically coupled to the first node, a second pole electrically coupled to the second node, and a gate;

b. a first amplifier having a first input, a second input and an output; and c. a second amplifier having a first input, a second input and an output, wherein the first inputs of the first and second amplifiers are electrically coupled to the first node, the second inputs of the first and second amplifiers are electrically coupled to the second node, and the outputs of the first and second amplifiers are electrically coupled to the gate of the transistor;

wherein the first amplifier has a characteristic time to reach a saturation value of voltage responsive to a voltage signal applied between the first and second inputs, wherein the characteristic time of the first amplifier is in the range of from 0.1 to 10 millisecond.

34. A voltage regulator for maintaining a voltage between a first node and a second node within a predetermined range, comprising:

a. a transistor having a first pole electrically coupled to the first node, a second pole electrically coupled to the second node, and a gate;

b. a first amplifier having a first input, a second input and an output; and c. a second amplifier having a first input, a second input and an output, wherein the first inputs of the first and second amplifiers are electrically coupled to the first node, the second inputs of the first and second amplifiers are electrically coupled to the second node, and the outputs of the first and second amplifiers are electrically coupled to the gate of the transistor;

wherein the first amplifier has a characteristic time to reach a saturation value of voltage responsive to a voltage signal applied between the first and second inputs, wherein the characteristic time of the first amplifier is in the range of from 0.1 to 10 microsecond.

35. A voltage regulator for maintaining a voltage between a first node and a second node within a predetermined range, comprising:

a. a transistor having a first pole electrically coupled to the first node, a second pole electrically coupled to the second node, and a gate;

b. a first amplifier having a first input, a second input and an output; and c. a second amplifier having a first input, a second input and an output, wherein the first inputs of the first and second amplifiers are electrically coupled to the first node, the second inputs of the first and second amplifiers are electrically coupled to the second node, and the outputs of the first and second amplifiers are electrically coupled to the gate of the transistor;

wherein the second amplifier has a characteristic time to reach a saturation value of voltage responsive to a voltage signal applied between the first and second inputs, wherein the characteristic time of the second amplifier is in the range of from 0.1 to 10 microsecond.

36. A voltage regulator for maintaining a voltage between a first node and a second node within a predetermined range, comprising:

a. a transistor having a first pole electrically coupled to the first node, a second pole electrically coupled to the second node, and a gate;

b. a first amplifier having a first input, a second input and an output; and c. a second amplifier having a first input, a second input and an output, wherein the first inputs of the first and second amplifiers are electrically coupled to the first node, the second inputs of the first and second amplifiers are electrically coupled to the second node, and the outputs of the first and second amplifiers are electrically coupled to the gate of the transistor;

wherein the second amplifier has a characteristic time to reach a saturation value of voltage responsive to a voltage signal applied between the first and second inputs, wherein the characteristic time of the second amplifier is in the range of from 0.1 to 10 nanosecond.

* * * * *

UNITED STATES PATENT AND TRADEMARK OFFICE

CERTIFICATE OF CORRECTION

PATENT NO. : 6,320,363 B1
DATED : November 20, 2001
INVENTOR(S) : Oglesbee et al.

It is certified that error appears in the above-identified patent and that said Letters Patent is hereby corrected as shown below:

Title page,
Inventor Gregory Smith's residence, change "Tuscon" to read -- Tucson --
Assignee, add -- National Semiconductor, Santa Clara, California --

Signed and Sealed this

Eighteenth Day of June, 2002

*Attest:*

*Attesting Officer*

JAMES E. ROGAN
*Director of the United States Patent and Trademark Office*